US009297103B2

(12) United States Patent
Fukao

(10) Patent No.: US 9,297,103 B2
(45) Date of Patent: Mar. 29, 2016

(54) SEWING MACHINE PRESSER ATTACHING MECHANISM AND SEWING MACHINE PROVIDED THEREWITH

(75) Inventor: Hiroaki Fukao, Kasugai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 1227 days.

(21) Appl. No.: 13/236,166

(22) Filed: Sep. 19, 2011

(65) Prior Publication Data

US 2012/0097085 A1 Apr. 26, 2012

(30) Foreign Application Priority Data

Oct. 22, 2010 (JP) ..... 2010-237387

(51) Int. Cl.
*D05B 29/12* (2006.01)

(52) U.S. Cl.
CPC ..... *D05B 29/12* (2013.01)

(58) Field of Classification Search
CPC ..... D05B 29/12; D05B 29/00; D05B 29/04; D05B 29/06; D05B 29/08
See application file for complete search history.

(56) References Cited

U.S. PATENT DOCUMENTS

| | | | | | |
|---|---|---|---|---|---|
| 2,878,765 | A | * | 3/1959 | Gegauf | 112/240 |
| 2,985,127 | A | * | 5/1961 | Reeber et al. | 112/240 |
| 3,145,674 | A | * | 8/1964 | Kurihara | 112/240 |
| 3,270,695 | A | * | 9/1966 | Ross | 112/240 |
| 3,457,889 | A | * | 7/1969 | Killinger et al. | 112/240 |
| 5,676,075 | A | * | 10/1997 | Chen | 112/240 |

FOREIGN PATENT DOCUMENTS

| | | |
|---|---|---|
| JP | Y2-56-45577 | 10/1981 |
| JP | U-60-50965 | 4/1985 |

* cited by examiner

*Primary Examiner* — Nathan Durham
(74) *Attorney, Agent, or Firm* — Oliff PLC

(57) ABSTRACT

A presser attaching mechanism for a sewing machine includes a locking mechanism switchable between a locking position where a presser foot or a presser holder is fixed to a presser bar and an unlocking position where the presser foot or the presser holder is released from the fixed state. The locking mechanism includes an operating member rotatable to the locking position and to the unlocking position. The presser bar is formed with a mount. The presser foot or the presser holder has a mounting wall and a mounting hole. The operating member is rotated from the unlocking position to the locking position, so that the operating member fixes the mounting wall to the mount. The locking mechanism has a biasing member which presses the operating member in a direction such that the mounting wall is pressed against the mount when the operating member is located at the locking position.

4 Claims, 11 Drawing Sheets

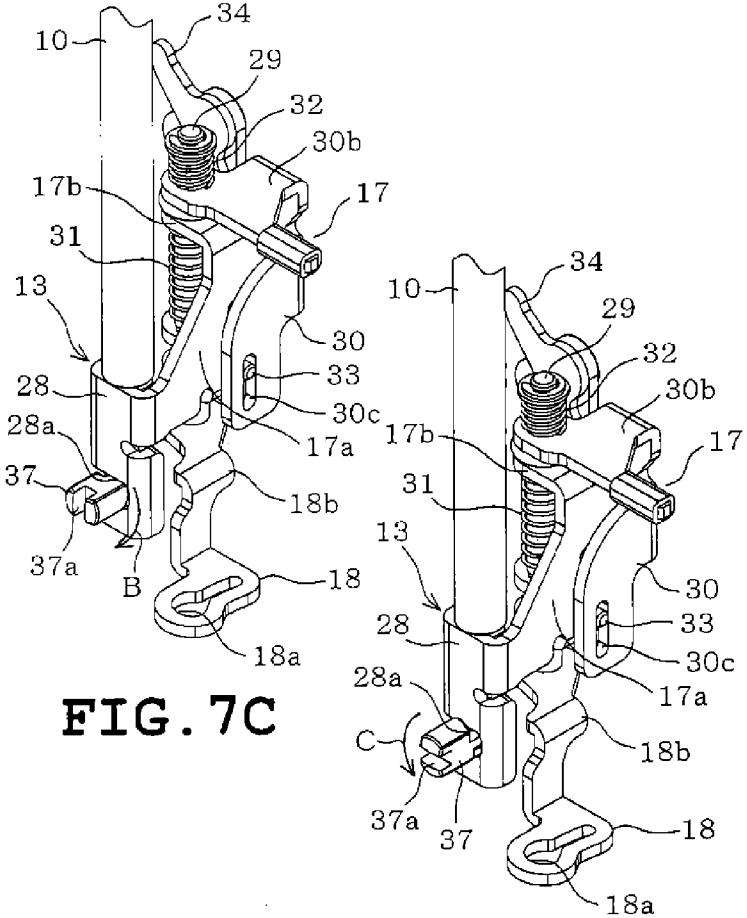
FIG. 7C
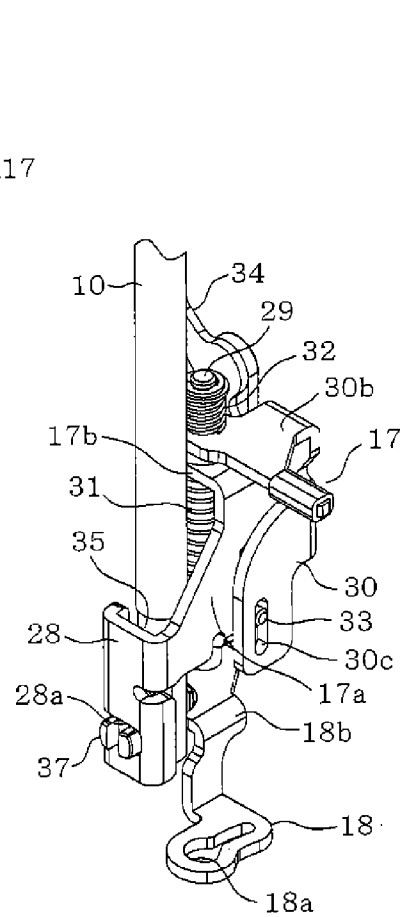
FIG. 7B
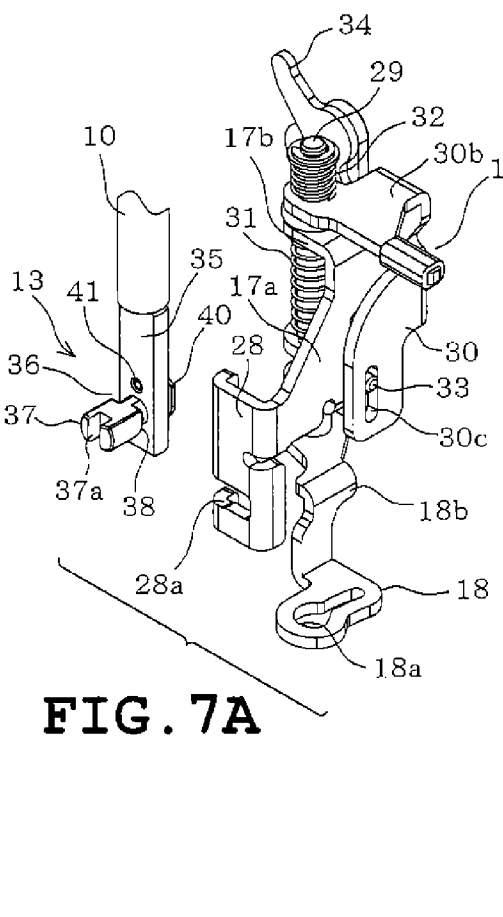
FIG. 7A
FIG. 7D

SEWING MACHINE PRESSER ATTACHING MECHANISM AND SEWING MACHINE PROVIDED THEREWITH

CROSS-REFERENCE TO RELATED APPLICATIONS

This application is based upon and claims the benefit of priority from the prior Japanese Patent Application No. 2010-237387 filed on Oct. 22, 2010, the entire contents of which are incorporated herein by reference.

BACKGROUND

1. Technical Field

The present disclosure relates to a sewing machine presser attaching mechanism which detachably attaches to a presser bar a presser foot pressing a workpiece cloth or a presser holder supporting the presser foot, and a sewing machine provided with the presser attaching mechanism.

2. Related Art

Household sewing machines have conventionally been provided with a presser bar located in the rear of a needle bar provided on a head, for example. The presser bar has a lower end to which a presser foot is detachably attached directly or indirectly via a presser holder to press a workpiece cloth. A plurality of types of presser feet is prepared according to sewing modes, for example, those for zigzag stitches, button holing and overcast stitches. The presser feet are changed from one to another as occasion demands. A conventional presser device includes a presser holder which is mounted to a lower end of a presser bar to be fixed in position. A presser foot is attached to and detached from the presser holder with just a single touch operation.

The above-described conventional presser device allows a user to easily change presser feet to be attached to and detached from the presser holder. However, for example, some types of presser feet can be mounted directly on the presser bar without use of a presser holder depending upon types of the presser feet, for example, presser feet for embroidery sewing. In this case, the user detaches a presser holder from the presser bar by loosening mounting screws with a tool such as a screwdriver. Subsequently, a presser foot for embroidery sewing is fixed to the presser bar by tightening attaching screws while retaining the presser foot at a mounting position with respect to the presser bar. Thus, change of the presser holder or the presser foot to be attached to the presser bar requires tightening and loosening the attaching screws depending upon the types of presser feet.

SUMMARY

Therefore, an object of the disclosure is to provide a presser attaching mechanism for a sewing machine, which can detachably attach the presser foot or the presser holder to the presser bar with ease and a sewing machine provided with the presser attaching mechanism.

The present disclosure provides a presser attaching mechanism for a sewing machine, which detachably attaches to a presser bar a presser foot pressing a workpiece cloth or a presser holder supporting the presser foot, the presser attaching mechanism comprising a locking mechanism which is provided on a lower end of the presser bar so as to be switchable between a locking position where the presser foot or the presser holder is fixed to the presser bar and an unlocking position where the presser foot or the presser holder is released from the fixed state to the presser bar. The locking mechanism includes an operating member rotatable to the locking position and to the unlocking position. The lower end of the presser bar is formed with a mount having a side from which the operating member protrudes. The presser foot or the presser holder has a mounting wall and a mounting hole. When the operating member is located at the unlocking position, the mounting wall is applied to the mount from a lateral direction, so that the operating member is inserted into the mounting hole. The operating member is rotated from the unlocking position to the locking position, so that the operating member fixes the mounting wall to the mount. The locking mechanism has a biasing member which presses the operating member in a direction such that the mounting wall is pressed against the mount when the operating member is located at the locking position.

The disclosure also provides a sewing machine comprising a sewing machine body, a presser bar provided on the sewing machine body so that a presser foot pressing a workpiece cloth or a presser holder supporting the presser foot is detachably attached to the presser bar, and, a presser attaching mechanism comprising a locking mechanism which is provided on a lower end of the presser bar so as to be switchable between a locking position where the presser foot or the presser holder is fixed to the presser bar and an unlocking position where the presser foot or the presser holder is released from the fixed state to the presser bar. The locking mechanism includes an operating member rotatable to the locking position and to the unlocking position. The lower end of the presser bar is formed with a mount having a side from which the operating member protrudes. The presser foot or the presser holder has a mounting wall and a mounting hole. When the operating member is located at the unlocking position, the mounting wall is applied to the mount from a lateral direction, so that the operating member is inserted into the mounting hole. The operating member is rotated from the unlocking position to the locking position, so that the operating member fixes the mounting wall to the mount. The locking mechanism has a biasing member which presses the operating member in a direction such that the mounting wall is pressed against the mount when the operating member is located at the locking position.

BRIEF DESCRIPTION OF THE DRAWINGS

FIGS. 7A, 7B, 7C and 7D are perspective views of the presser attaching mechanism, showing a procedure for attaching the presser foot for embroidery sewing (Nos. 1 to 4);

DETAILED DESCRIPTION

Figure 1:
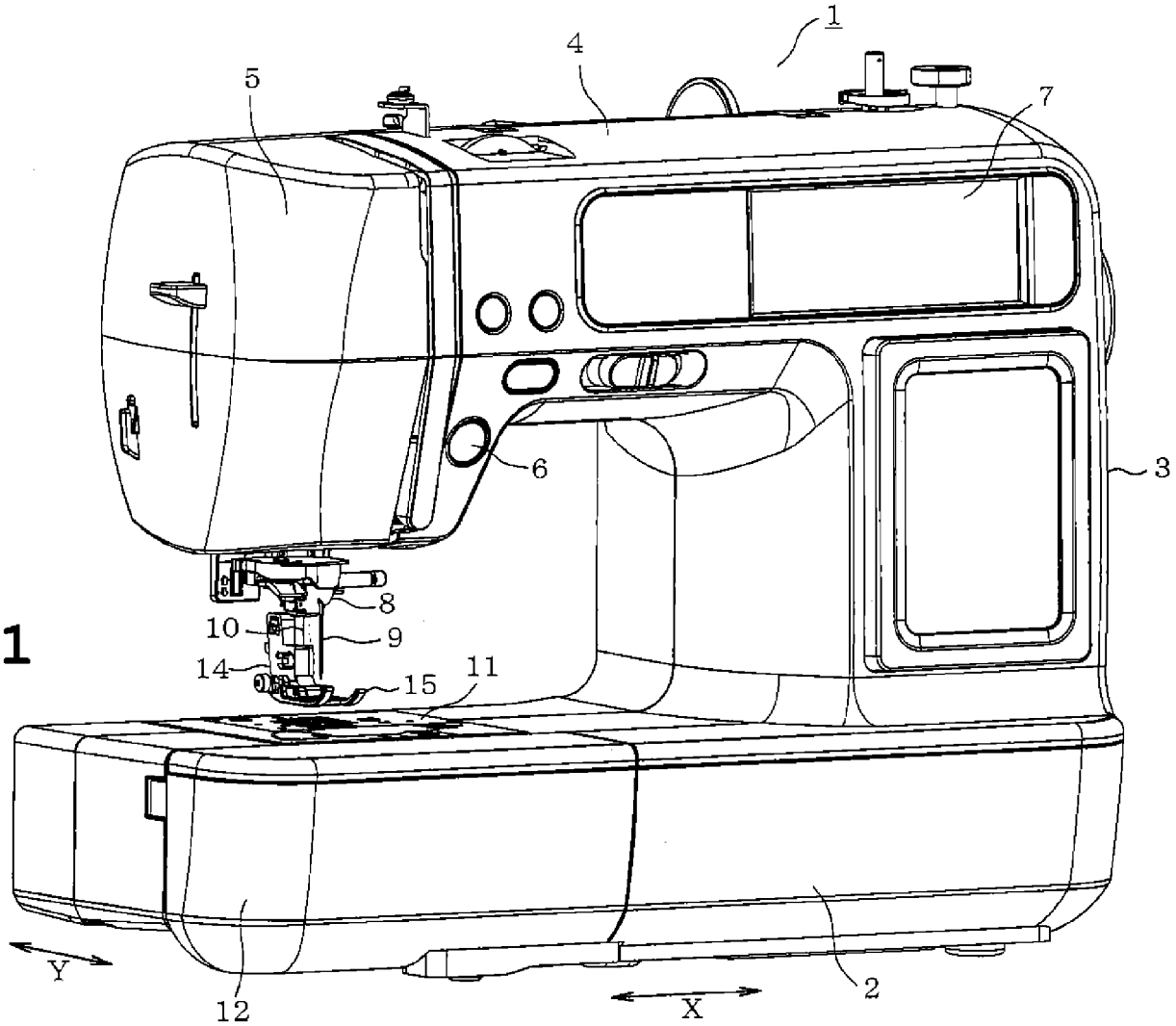
FIG. 1 is a plan view of a sewing machine according to one embodiment.

An embodiment will be described with reference to FIGS. 1 to 10F. Referring to FIG. 1, an overall household sewing machine 1 capable of performing embroidery sewing is shown as viewed from the front or the user side. The side where the user is located will hereinafter be referred to as "front" and the opposite side will be referred to as "back." A front-back direction will be referred to as "Y direction." The side where a pillar 3 is located will be referred to as "right" and the opposite side will be referred to as "left." A right-left direction will be referred to as "X direction."

The sewing machine 1 includes a bed 2 extending in the right-left direction, a pillar 3 extending upward from a right end of the bed 2 and an arm 4 extending leftward from an upper end of the pillar 3. The arm 4 has a distal end serving as a head 5. On the front of the arm 4 are provided various operation switches including a start/stop switch 6 instructing start and stop of embroidery sewing and a liquid crystal display 7 having a touch panel. A needle bar 8 is mounted on the head 5 so as to be movable upward and downward. The needle bar 8 has a lower end to which a needle 9 is attached. A needle bar mechanism (not shown) is provided in the head 5 for moving the needle bar 8 upward and downward. A presser bar 10 is mounted on the rear of the needle bar 8. A presser foot lifting mechanism (not shown) is provided which has a presser-up lever (not shown) for lifting the presser bar 10 between an up-position and a down-position. A presser foot (not shown) or a presser holder (not shown) is mounted on a distal or lower end of the presser bar 10. The presser foot presses a workpiece cloth (not shown), and the presser holder supports the presser foot. The presser bar 10, the presser foot and the presser holder will be described in detail later.

A needle plate 11 is mounted on an upper surface of the sewing machine bed 2, so as to correspond to the needle bar 8. In the bed 2 are provided a hook mechanism and a feed mechanism although neither is shown. The hook mechanism is located below the needle plate 11 and accommodates a bobbin to form stitches on the workpiece cloth in cooperation with the needle 9. The feed mechanism includes feed dogs provided for feeding the workpiece cloth in the front-back direction. The feed mechanism drives the feed dogs in the front-back direction and in the up-down direction in synchronization with up-down movement of the needle bar 8. Furthermore, the sewing machine 1 includes a sewing machine motor (not shown) to drive the needle bar mechanism, the hook mechanism and the feed mechanism.

An auxiliary table 12 is detachably attached to the bed 2 as shown in FIG. 1. The auxiliary table 12 is used to enlarge a plane on which the workpiece cloth is placed. The sewing machine 1 can perform sewing of ordinary stitches (an ordinary sewing mode) such as straight stitches or zigzag stitches while the workpiece cloth is fed by the feed dogs. Furthermore, a known embroidery machine (an embroidery frame moving device) is detachably attached to the bed 2 with the auxiliary table 12 being detached. In use of the embroidery machine, an embroidery frame holding the workpiece cloth is detachably attached to the embroidery machine. The embroidery machine is provided with an embroidery frame transfer mechanism (not shown) which transfers the embroidery frame on the bed 2 or the needle plate 11 in the X direction (the right-left direction) and the Y direction (the front-back direction) perpendicular to the X direction. The embroidery frame transfer mechanism has an X-direction drive motor and a Y-direction drive motor although neither is shown. When the embroidery machine is attached to the bed 2, the sewing machine 1 is automatically set to an embroidery sewing mode such that embroidery sewing can be executed on the workpiece cloth held by the embroidery frame.

Figure 2C:
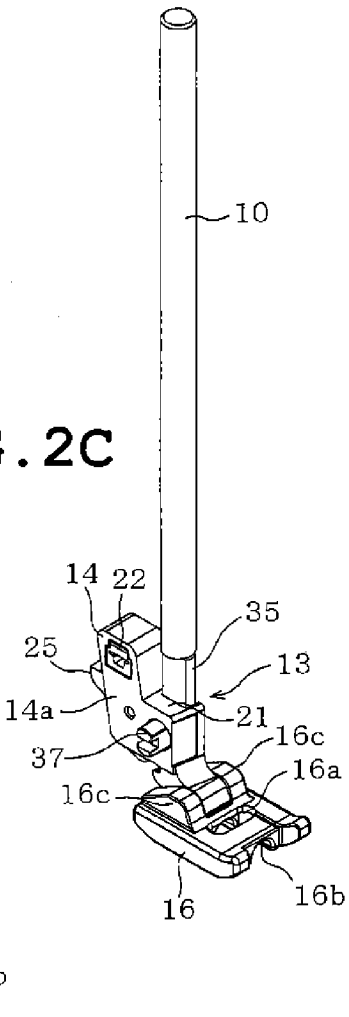
FIGS. 2A, 2B and 2C are perspective views showing the case where a general-purpose presser foot is attached to a presser holder, the case where a presser foot is detached from the presser holder and the case where a pearl-attaching presser foot is attached to the presser holder, respectively.
Figure 2B:
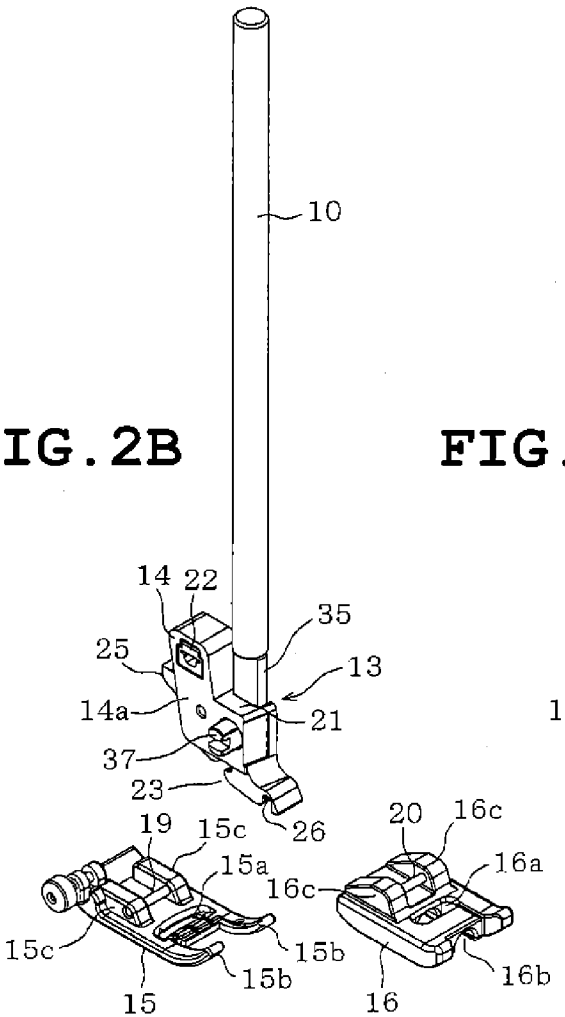
Figure 2A:
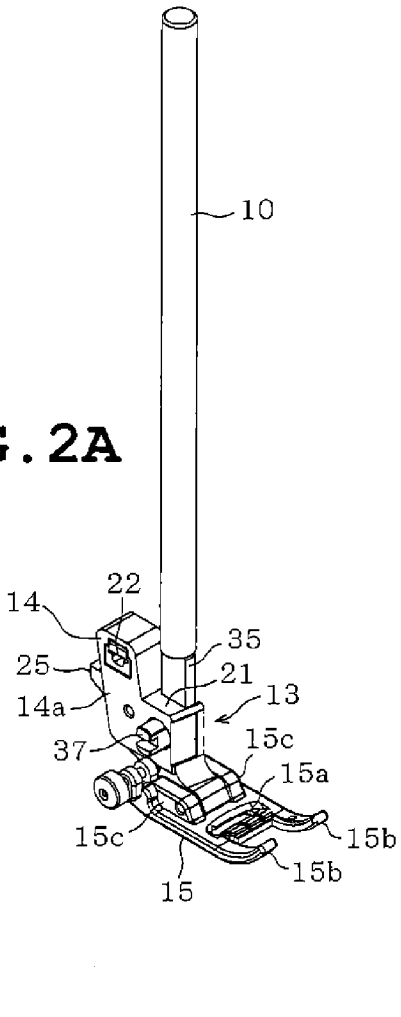

Next, a presser attaching mechanism 13 will be described with reference to FIGS. 2A to 10F. The presser attaching mechanism 13 attaches a presser foot to a lower end of the presser bar 10 or a presser holder supporting the presser foot to the presser bar 10. In execution of the ordinary sewing mode, the presser holder 14 is attached to the lower end of the presser bar 10 as shown in FIGS. 2A to 6C. A plurality of types of presser feet is prepared according to types of ordinary sewing modes, and one of the presser feet is detachably or replaceably attached to the presser holder 14. FIGS. 2A to 2C exemplifies as the presser foot a general-purpose presser foot 15 used for straight stitches or zigzag stitches and a pearl-attaching presser foot 16 used for decorative stitches to sew onto a workpiece cloth a string of pearls, a cord or the like. On the other hand, in execution of embroidery sewing, a presser foot 17 for embroidery sewing is attached to the lower end of the presser bar 10 as shown in FIGS. 7A to 7D and 8A to 8C.

The general-purpose presser foot 15 is formed into the shape of a rectangular plate slightly longer in the front-back direction and has a through hole 15*a* which is formed in a part thereof near the front so as to be elongate in the right-left direction. The needle 9 is adapted to pass through the elongate hole 15*a*. The general-purpose presser foot 15 also has two protrusions 15*b* which are formed integrally therewith and extend forward from right and left sides thereof respectively. The protrusions 15*b* are slightly bent upward for the purpose of guiding a workpiece cloth. The general-purpose presser foot 15 further has a pair of right and left supports 15*c* formed substantially in a middle part thereof in the front-back direction and a mounting shaft 19 which extends in the right-left direction so as to connect between the supports 15*c*.

The pearl-attaching presser foot 16 has a generally elongate hole 16*a* through which the needle 9 passes as shown in FIGS. 2B and 2C. The pearl-attaching presser foot 16 also has a guide 16*b* which is formed in a front underside thereof to guide the pearl string or the cord. The pearl-attaching presser foot 16 further has a pair of right and left supports 16*c* and a mounting shaft 20 extending in the right-left direction so as to connect between the supports 16*c*.

Figure 5C:
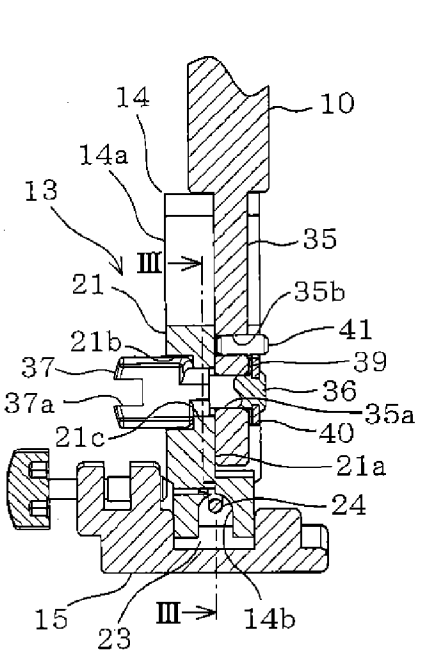
FIGS. 5A, 5B and 5C are a left side view, a front view and a longitudinal front section (a sectional view taken along line V-V in FIG. 5A) of an operating member occupying a locking position, respectively.
Figure 5B:
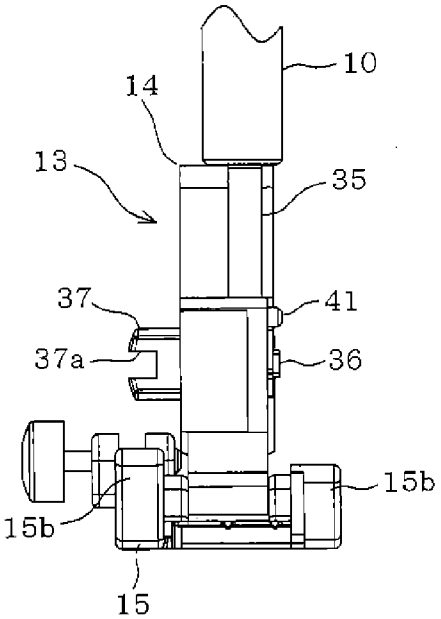
Figure 5A:
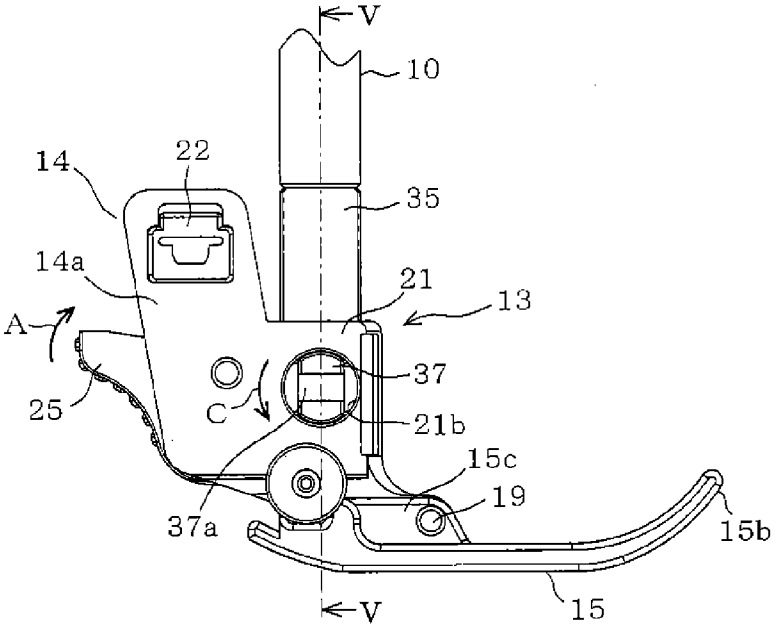
Figure 6C:
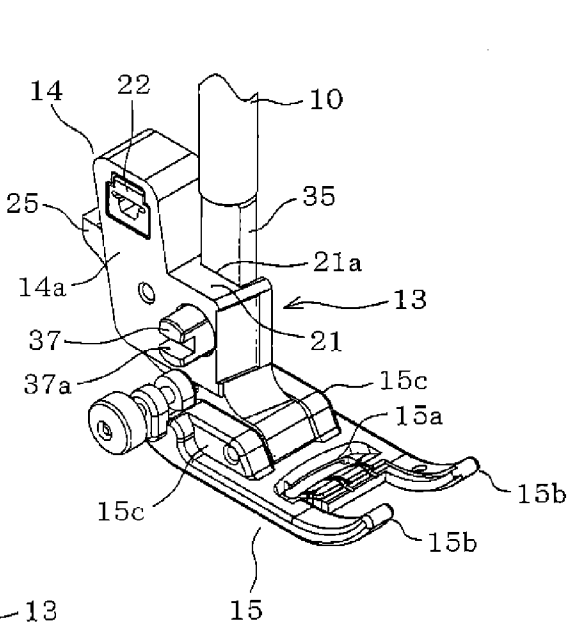
FIGS. 6A, 6B and 6C are perspective views showing a procedure for attaching the presser holder (Nos. 1 to 3)

The presser holder 14 includes a generally L-shaped block-like holder body 14*a* as viewed from the left side surface thereof, as shown in FIGS. 3 to 6C as well as in FIGS. 2A to 2C. The holder body 14*a* includes a mounting wall 21 formed in a part thereof except for a front-half lower end. The mounting wall 21 is to be mounted to the presser bar 10 as will be described later. The mounting wall 21 has a rightwardly open recess 21*a* as shown in FIGS. 6A to 6C. A part of the mounting wall 21 except a front end thereof has a thickness corresponding to a thickness of a left-half of the entire holder body 14*a* in the right-left direction as viewed at the front.

Figure 3:
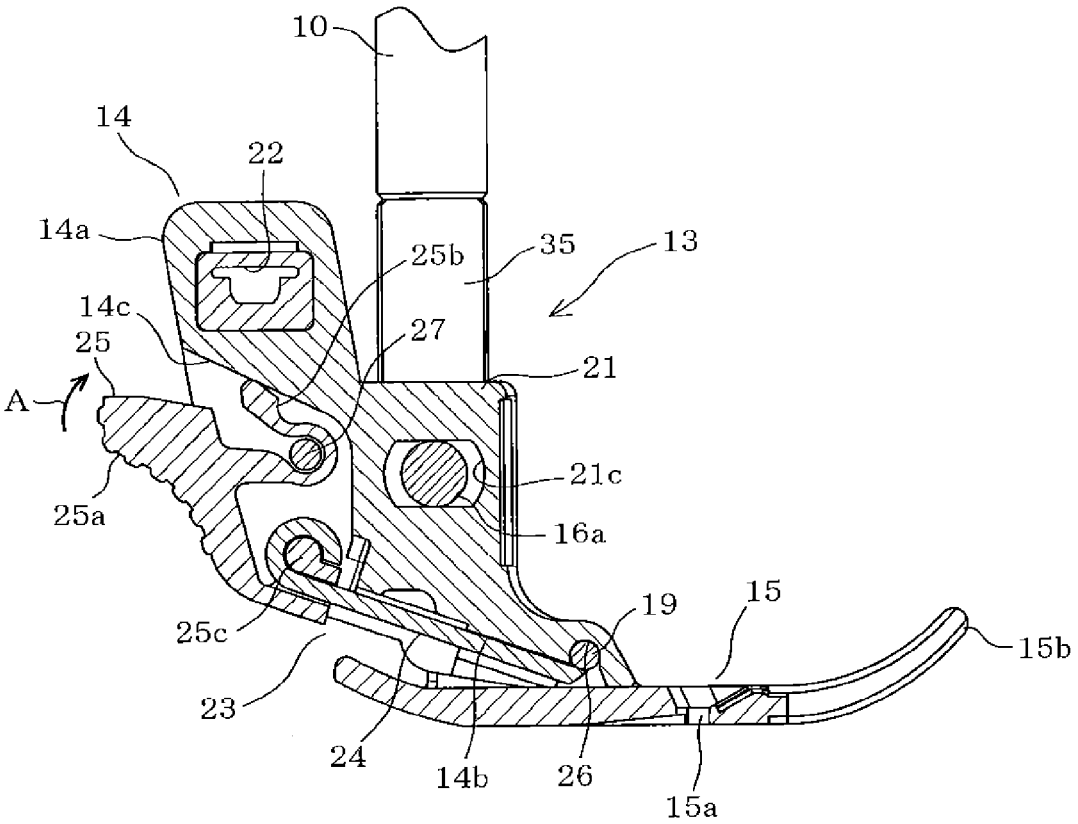
FIG. 3 is a longitudinal left side section of the presser holder to which the general-purpose presser foot is attached or a sectional view taken along line in FIG. 5.
Figure 4C:
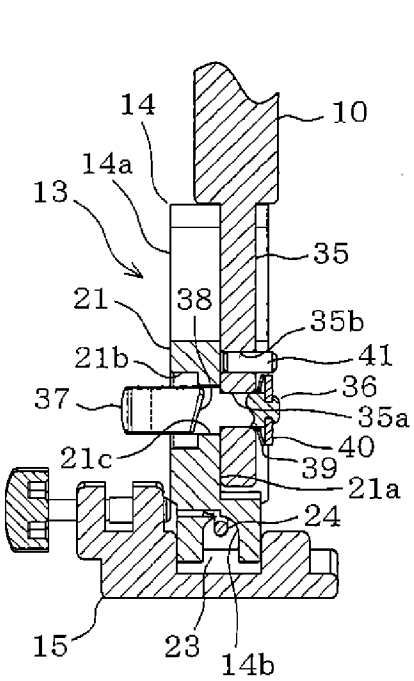
FIGS. 4A, 4B and 4C are a left side view, a front view and a longitudinal front section (a sectional view taken along line IV-IV in FIG. 4A) of an operating member occupying an unlocking position, respectively.

A known quilter mount 22 is provided on a rear upper part of the holder body 14*a*. A quilting ruler bar (not shown) is detachably attached to the quilter mount 22. An attaching/detaching mechanism 23 is provided on a lower part of the holder body 14*a* or a part of the holder body 14*a* located between the lower front end and the rear, as shown in FIGS. 3, 4C and 5C. The attaching/detaching mechanism 23 attaches and detaches the presser foot 15 or 16 to and from the presser bar 10 with a single touch operation. The attaching/detaching mechanism 23 includes a fitting groove 26 into which the mounting shaft 19 of the presser foot 15 or the mounting shaft 20 of the presser foot 16 is fitted, as shown in FIG. 3. The attaching/detaching mechanism 23 also includes a wire rod 24 which locks the mounting shaft 19 or 20 so that the mounting shaft 19 or 20 is prevented from dropping out of the fitting groove 26. The attaching/detaching mechanism 23 further includes a lever member 25 which releases the mounting shaft 19 or 20 from the locked state.

The fitting groove 26 into which the mounting shaft 19 or 20 is fitted is formed in the front end underside of the holder body 14*a* so as to extend in the right-left direction and so as to be open downward. The underside of the holder body 14*a* has a recessed groove 14*b* which extends rearward from the fitting groove 26 and is upwardly inclined, as shown in FIGS. 4C and 5C. The recessed groove 14*b* is formed so that the upward inclination thereof is rendered steeper as the recessed groove 14*b* goes rearward. In this case, a recess 14*c* which is open downward and rearward is formed under the quilter mount 22, as shown in FIG. 3. A pin 27 supporting the lever member 25 is provided in the recess 14*c* so as to extend in the right-left direction.

The lever member 25 includes a lever 25*a* protruding rearward from the recess 14*c*, a spring 25*b* extending forward from the lever 25*a* and then folded rearwardly upward and a wire rod mount 25*c* located below the lever 25*a*, as shown in FIG. 3. The lever 25*a*, the spring 25*b* and the wire rod mount 25*c* are formed integrally with the lever member 25. The spring 25*b* is engaged with the pin 27 so as to be wound around the pin 27 and has a distal end that is elastically in contact with the ceiling wall of the recess 14*c*. As a result, the lever 25*a* is swingable upward. The wire rod 24 has a distal end disposed below the fitting groove 26 and a proximal end which is mounted to the wire rod mount 25*c* thereby to obliquely extend in the front-back direction in the recessed groove 14*b*.

As a result, the distal end of the wire rod 24 is located under the fitting groove 26 thereby to close the fitting groove 26 under a normal condition or when the lever 25*a* has not been operated by the user, as shown in FIG. 3. Accordingly, since the mounting shaft 19 or 20 is locked so as to be prevented from dropping out of the fitting groove 26, the presser foot 15 or 16 is supported by the presser holder 14.

When the presser foot 15 or 16 is to be detached from the presser holder 14, the user operates the presser-up lever (not shown) to switch the presser bar 10 and the presser holder 14 to respective up-positions. When the user operates the lever 25*a* upward or in the direction of arrow A in FIG. 3, the lever member 25 is swung with the spring 25*b* being elastically deformed, whereupon the wire rod 24 is moved rearward. As a result, since the distal end of the wire rod 24 is retreated rearward from the fitting groove 26, the fitting groove 26 is opened downward such that the mounting shaft 19 or 20 is allowed to drop out of the fitting groove 26 downward. Consequently, the presser foot 15 or 16 is allowed to fall by self-weight thereby to be detached from the presser holder 14.

When the presser foot 15 or 16 is to be attached to the presser holder 14, the user operates the presser-up lever to switch the presser bar 10 and the presser holder 14 to the respective down-positions. In this case, when the mounting shaft 19 or 20 abuts on the distal end of the wire rod 24, the distal end of the wire rod 24 is retreated rearward from the fitting groove 26 against the spring force, whereupon the mounting shaft 19 or 20 is allowed to be moved until the mounting shaft 19 or 20 abuts on the upper surface of the fitting groove 26. When the mounting shaft 19 or 20 abuts on the upper surface of the fitting groove 26, the distal end of the wire rod 24 is located under the fitting groove 26 by the elastic force of the spring 25*b* thereby to substantially close the fitting groove 26, namely, the mounting shaft 19 or 20 is locked so as to be prevented from dropping out of the fitting groove 26. Thus, the presser foot 15 or 16 is attached to the presser holder 14.

On the other hand, the configuration of the presser foot 17 for embroidery sewing will be described as follows with reference to FIGS. 7A to 7D and 8A to 8C. The embroidery-sewing presser foot 17 includes a base plate 17*a* and a mounting plate 28 both of which are formed integrally with the presser foot 17.

The mounting plate 28 is located on a left end of the base plate 17*a*. The mounting plate 28 is mounted on the presser bar 10 in a manner as will be described later. The mounting plate 28 extends vertically and is formed into a bent shape with a right opening, as shown in FIGS. 7A to 7D. The base plate 17*a* is disposed on the front of the presser bar 10 and extends obliquely rightwardly upward from the upper front of the mounting plate 28.

Figure 8C:
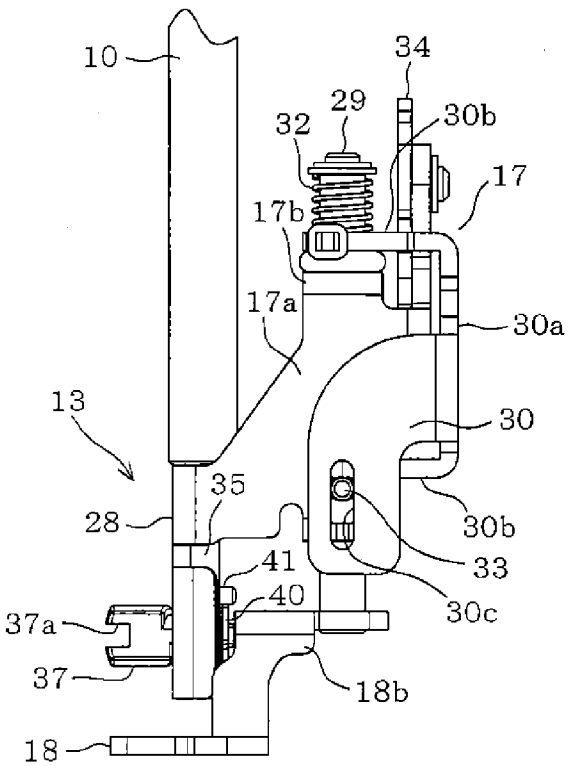
FIGS. 8A, 8B and 8C are front views of the presser attaching mechanism, showing a procedure for attaching the presser foot for embroidery sewing (Nos. 1 to 3)
Figure 8B:
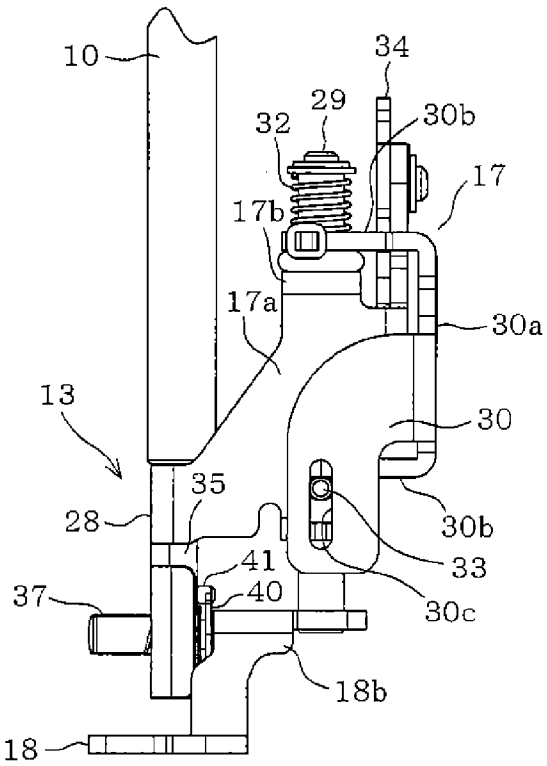
Figure 8A:
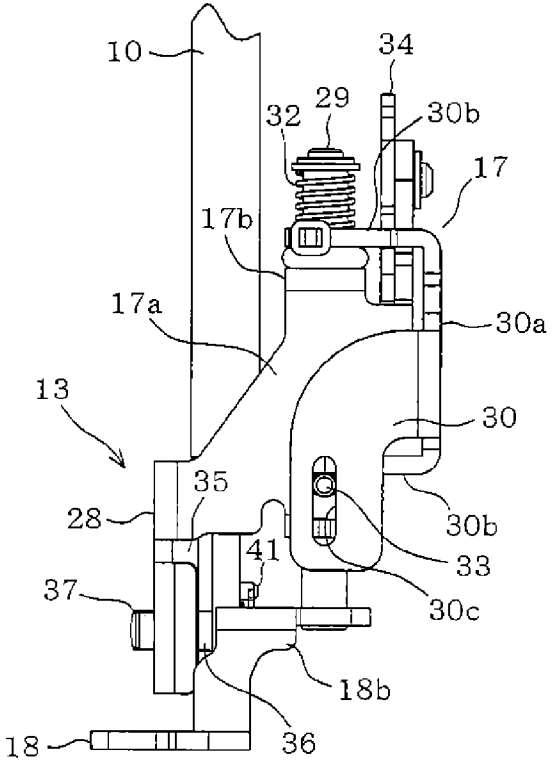

The base plate 17*a* has a right end formed with a pair of supports 17*b* which are bent at right angles from upper and lower sides thereof and extend horizontally rearward, respectively. Only the upper support 17*b* is shown in FIGS. 7A to 7D. A support shaft 29 extends through the paired supports 17*b* thereby to be supported so as to be movable upward and downward. The presser foot 18 is formed into a flat plate shape and has a hole 18*a* through which the needle 9 passes. The presser foot 18 also has an extending portion 18*b* which is formed integrally therewith so as to extend upward from the rear thereof as shown in FIGS. 8A to 8C as well as in FIGS. 7A to 7D. The extending portion 18*b* has an upper end secured to the lower end of the support shaft 29.

An auxiliary plate 30 is provided so as to overlap the front surface of the base plate 17*a*. The auxiliary plate 30 has a right side plate 30*a* which is located on the right of the base plate 17*a* and is bent at right angles rearward from a right side of the auxiliary plate 30, extending vertically. The auxiliary plate 30 also has a pair of supports 30*b* which are formed integrally therewith so as to be bent at right angles from the upper and lower sides thereof and to extend horizontally leftward, respectively. In this case, the upper support 30*b* is located above the upper support 17*b* of the base plate 17*a*, whereas the lower support 30*b* is located above the lower support 17*b* of the base plate 17*a*. The support shaft 29 extends through the supports 30*b*, too.

A first coil spring 31 is provided around the support shaft 29 so as to be located between the upper support 17*b* of the base plate 17*a* and the lower support 30*b* of the auxiliary plate 30 as shown in FIGS. 7A to 7D. As a result, the auxiliary plate 30 is biased downward relative to the base plate 17*a* by the first coil spring 31. Furthermore, a second coil spring 32 is provided around the support shaft 29 so as to be located between the upper end of the support shaft 29 and the upper support 30*b* of the auxiliary plate 30. As a result, the support shaft 29 is biased upward relative to the auxiliary plate 30 by the second coil spring 32.

A limit pin 33 is provided on a lower part of the support shaft 29 so as to protrude forward. The limit pin 33 extends through a vertically long slit (not shown) formed in the base plate 17*a* and a vertically long slit 30*c* formed in the auxiliary plate 30. As a result, rotational directions and vertical relative movement of the support shaft 29, the base plate 17*a* and the auxiliary plate 30 are limited by the limit pin 33. A pivot lever 34 is mounted on an upper part of the auxiliary plate 30 to move the presser foot 18 upward relative to the base plate 17*a*.

Figure 9A:
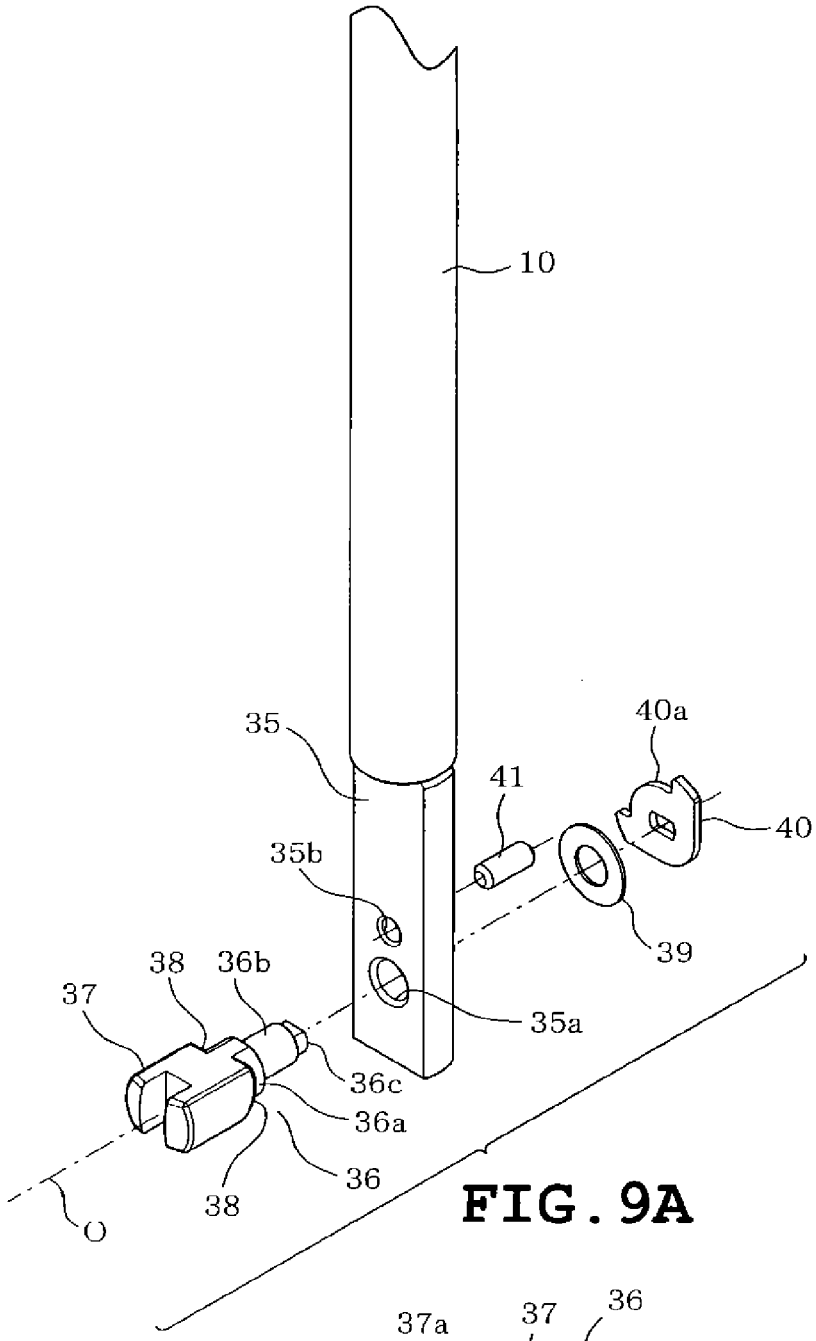
FIGS. 9A and 9B are an exploded perspective view of a lower end of the presser bar and a perspective view of the operating member, respectively.

A presser attaching mechanism 13 according to the embodiment is constructed as follows. Firstly, the presser bar 10 is generally formed into the shape of a round bar and has a lower end provided with a mount 35 which is formed into the shape of a flat plate that is thin in the right-left direction, as shown in FIGS. 2A to 2C, 7A to 7D, 9A and the like. The mount 35 has an insertion hole 35*a* located in a lower part thereof and a pin mounting hole 35*b* located above the insertion hole 35*a*, as shown in FIG. 9A. The pin mounting hole 35*b* has a smaller diameter than the insertion hole 35*a*.

Figure 9B:
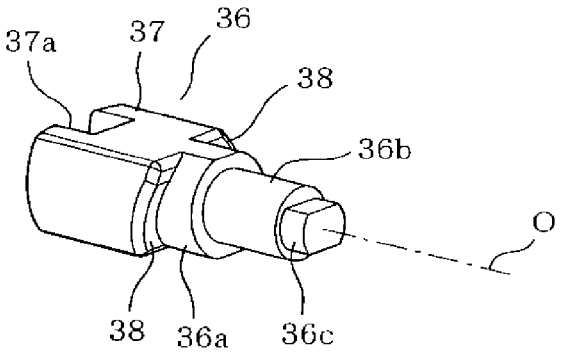

An operating member 36 constituting a locking mechanism is inserted through the insertion hole 35*a* thereby to be mounted. The operating member 36 is formed into the shape of a bar and is elongated in the right-left direction or in the direction of a rotational axis O in FIG. 9A, as shown in FIGS. 10A to 10F as well as FIGS. 2A to 9B. More specifically, the operating member 36 includes a head 37, a first shaft 36*a*, a second shaft 36*b* and a mount 36*c* sequentially from the left, all of which are formed integrally with the operating member 36, as shown in FIG. 9B. The head 37 is formed into a shape obtained by cutting, on a horizontal plane, upper and lower parts of a cylinder having a larger diameter than the first shaft 36*a* or the shape of an elliptic column that has flat upper and lower surfaces and is elongated from front to back. The head 37 has a left distal end surface formed with a lengthwise extending groove 37*a* for insertion of a tool such as a straight slot screwdriver.

The mounting wall 21 of the presser holder 14 and the mounting plate 28 of the embroidery sewing presser foot 17 have respective mounting holes which are each formed into the shape of a horizontally long ellipse and through which the head 37 is insertable. The first shaft 36*a* located on the right of the head 37 is formed into the shape of a column having a diameter corresponding to a short axis (an up-down dimension). The second shaft 36*b* has a slightly smaller diameter than the first shaft 36*a* and is formed into the shape of a column having such an outer diameter that the first shaft 36*a* is rotatably inserted into the insertion hole 35*a* of the mount 35. The mount 36*c* is formed into a horizontally long elliptic shape and has a slightly smaller diameter than the second shaft 36*b*.

Figure 10D:
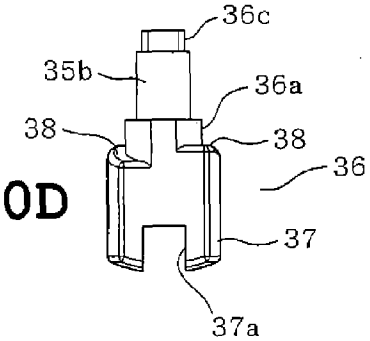
FIGS. 10A, 10B, 10C, 10D, 10E and 10F are front, left side, right side, top plan, bottom and rear views of the operating member with the distal end surface of the head being the front, respectively.
Figure 10C:
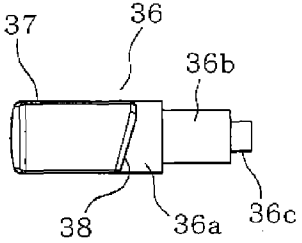
Figure 10F:
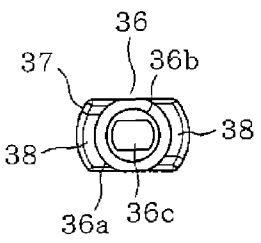
Figure 10A:
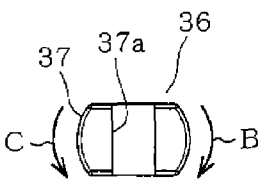
Figure 10B:
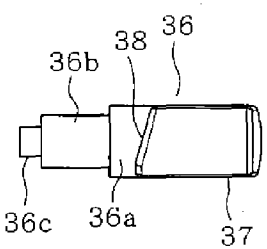
Figure 10E:
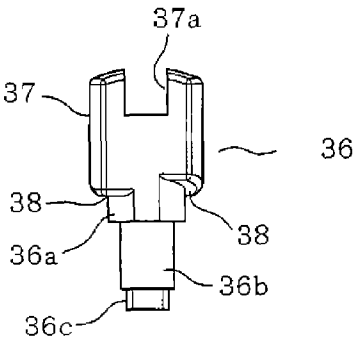

The first shaft 36*a* has two surfaces which are continuous to a periphery thereof and are located in front and on the back thereof. The surfaces serve as engaging portions which are to engage engaged portions of the mounting wall 21 and the mounting plate 28 respectively, as will be described later. These engaging portions are located so as to be symmetric about an imaginary plane passing the rotational axis O (a vertical plane passing the rotational axis O, in the embodiment). The engaging portions are formed with respective cam surfaces 38. The front cam 38 is inclined so as to come closer to the first shaft 36*a* side as the front cam 38 goes upward, as shown in FIG. 9B. The rear cam 38 is inclined so as to come closer to the first shaft 36*a* as the rear cam 38 goes downward, as shown in FIGS. 10B, 10D, 10E and the like.

The operating member 36 thus configured is mounted in the insertion hole 35*a* of the mount 35 of the presser bar 10 as shown in FIGS. 4C, 5C and 9A. More specifically, the operating member 36 is inserted through the insertion hole 35*a* from the left so that the second shaft 36*b* is disposed in the insertion hole 35*a*. A wave spring 39 serving as a biasing member is disposed around the second shaft 36*b* from the right of the mount 35. Furthermore, the right distal end of the mount 36*c* is squeezed such that the stop ring 40 is fixed to the mount 36*c*. A stopper pin 41 is press fitted into the pin mounting hole 35*b* from the right thereby to be fixed in position. The stopper pin 41 is locked by the stop ring 40, whereby a rotative movement limiting portion 40*a* is provided for limiting a rotative movement range of the operating member 36 to about 90°.

Consequently, the operating member 36 is rotatable about the rotational axis O relative to the mount 35 of the presser bar 55. The operating member 36 is rotatable (switchable) between a first position (an unlocking position) where the head 37 is situated transverse or horizontally long as shown in FIGS. 4A to 4C and a second position (a locking position) where the head 37 is rotated 90° in the direction of arrow B (clockwise as viewed from the left side) from the unlocking position thereby to be vertical or vertically long as shown in FIGS. 5A to 5C.

On the other hand, the mounting wall 21 of the presser holder 14 has a circular recess 21*b* which is open at the left side thereof and has a depth that is substantially one-half of a thickness thereof, as shown in FIGS. 4A, 4C, 5A, 5C and 6A. The circular recess 21*b* has an inner diameter that is slightly larger than a long axis of the head 37 of the operating member 36 such that the head 37 is rotatively movable. The mounting wall 21 further has a mounting hole 21*c* extending through the right wall thereof from the bottom of the circular recess 21*b*. The mounting hole 21*c* is formed into a horizontally long elliptic shape which corresponds to the shape of the head 37 of the operating member 36, so that the head 37 is sized so as to be insertable through the mounting hole 21*c*.

Figure 4B:
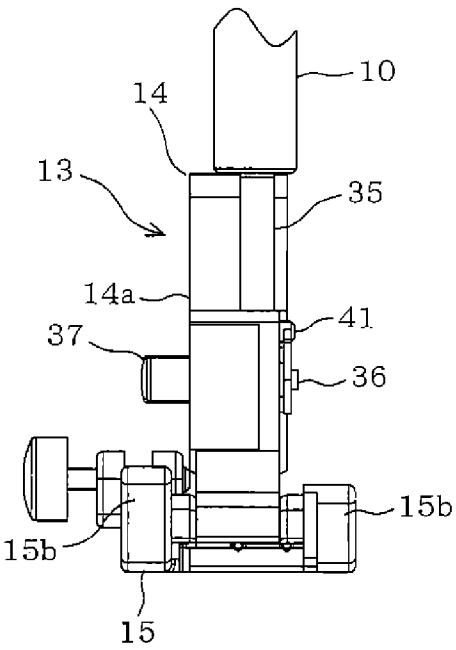
Figure 4A:
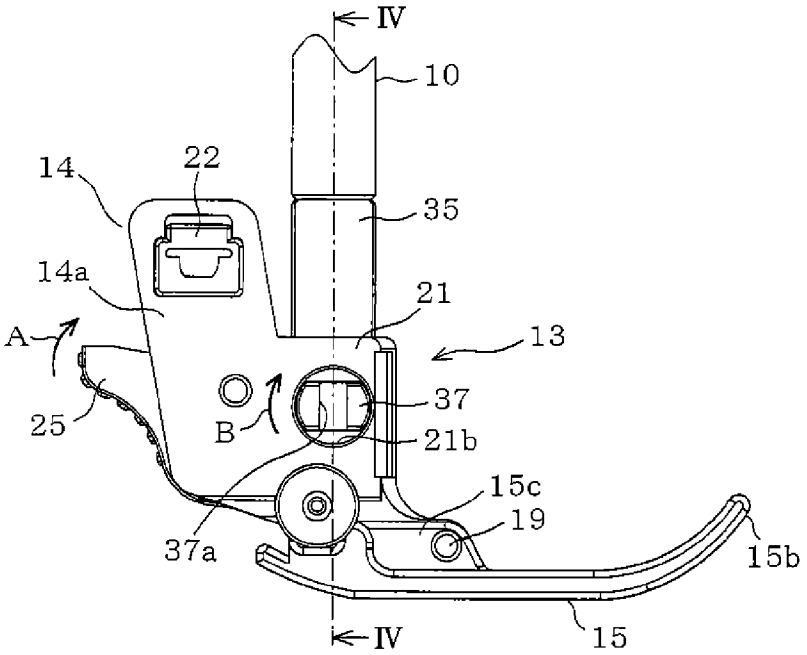

As the result of the above-described configuration, when situated transverse or horizontally long as shown in FIGS. 4A to 4C, the head 37 of the operating member 36 is insertable through the mounting hole 21*c* of the mounting wall 21. Thus, the position where the head 37 of the operating member 36 is situated transverse or horizontally long corresponds to the unlocking position where the presser bar 10 has been released from fixation to the presser holder 14.

The operating member 36 is then rotated substantially 90° in the direction of arrow B (see FIG. 4A) after the head 37 thereof has been inserted into the mounting hole 21*c* of the mounting wall 21. The cam surface 38 that is the engaging portion of the right side surface of the head 37 adheres closely to the engaged portion or a part of the bottom of the circular recess 21*b* around the mounting hole 21*c* or upper and lower portions, thereby adhering closely to the mount 35 so that the mounting wall 21 is held between the mount 35 and the cam surface 38, as shown in FIGS. 5A to 5C. As a result, the presser holder 14 is fixed to the presser bar 10. Thus, the position where the head 37 of the operating member 36 is directed vertically or is vertically long corresponds to the locking position. In this case, the wave spring 39 is compressed thereby to produce a biasing force. The biasing force acts in such a direction that the mounting wall 21 is pressed against the mount 35. Furthermore, the wave spring 39 is gradually compressed by the action of the cam surface 38 when the head 37 is rotated in the direction of arrow B, whereupon the biasing force is gradually increased.

The mounting plate 28 of the embroidery sewing presser foot 17 is also formed with a mounting hole 28*a* which has a horizontally long shape corresponding to the shape of the head 37 and through which the head 37 is passed. The mounting hole 28*a* has an opening located in the rear of the mounting plate 28. As a result, the head 37 can be inserted into the mounting hole 28*a* when the operating member 36 occupies the unlocking position and the mounting plate 28 or the embroidery sewing presser foot 17 can be fixed to the presser bar 10 when the operating member 36 occupies the locking position, in the same manner as the presser holder 14.

Figure 6B:
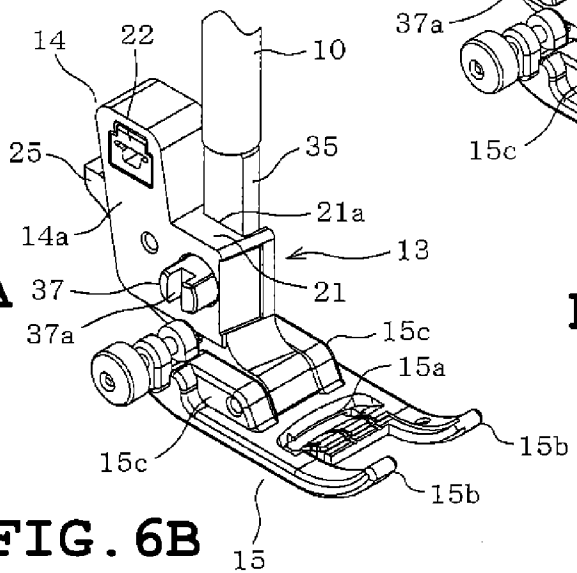
Figure 6A:
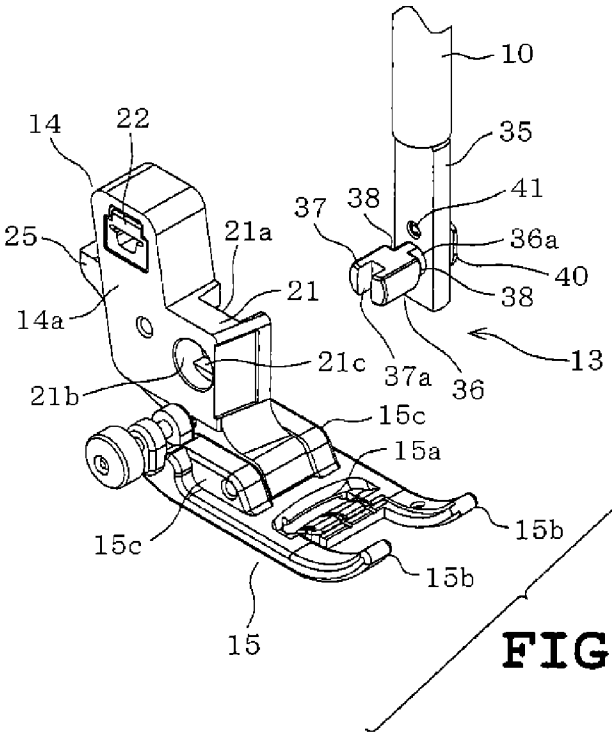

The above-described presser attaching mechanism 13 will work as follows. Firstly, the following describes the procedure for mounting the ordinary sewing holder 14 on the mount 35 of the presser bar 10. When attaching the presser holder 14 to the presser bar 10, the user switches the head 37 of the operating member 36 to the unlocking position as shown in FIG. 6A. The head 37 is then inserted into the mounting hole 21*c* of the mounting wall 21 of the presser holder 14 as shown in FIG. 6B. In this case, the presser holder 14 is disposed so that the left surface of the mount 35 and the right surface of the mounting wall 21 are caused to adhere to each other while the mount 35 is fitted with the recess 21*a* of the mounting wall 21, as shown in FIG. 4C as well as FIGS. 5C and 6C. The user then inserts a suitable tool into the groove 37*a* of the head 37 to rotate the head 37 substantially 90° clockwise (in the direction of arrow B), so that the head 37 is switched from the unlocking position to the locking position. The cam surface 28 serving as the engaging portion located on the right side surface of the head 37 presses the bottom of circular recess 21*b* serving as the engaged portion rightward (in the direction of the mount 35), whereupon the presser holder 14 is fixed to the presser bar 10, as shown in FIGS. 5C, 6C and the like. Thus, when the presser holder 14 is fixed to the presser bar 10, the presser foot 15 or 16 can be attached to and detached from the presser holder 14 by the attaching/detaching mechanism 23, whereupon the presser foot 15 or 16 can easily switched.

Furthermore, the embroidery sewing presser foot 17 needs to be attached to the presser bar 10 when the sewing work is switched from an ordinary sewing mode to an embroidery sewing mode. More specifically, the presser holder 14 needs to be detached from the presser bar 10 and the embroidery sewing presser foot 17 needs to be attached to the presser bar 10. In this case, the head 37 occupying the locking position is rotated substantially 90° counter-clockwise (in the direction of arrow C in FIG. 5A) contrary to the above, so that the head 37 is changed to the unlocking position. As a result, the head 37 can be dropped out of the mounting hole 21*c* of the mounting wall 21 and the presser holder 14 can be detached leftward.

When attaching the embroidery sewing presser foot 17 to the presser bar 10, the user causes the head 37 to occupy the unlocking position as shown in FIG. 7A and inserts the head 37 into the mounting hole 28*a* of the mounting plate 28 of the embroidery sewing presser foot 17 as shown in FIGS. 7B and 8A. The left side surface of the mount 35 and the right side surface of the mounting plate 28 are caused to adhere to each other while the mounting plate 28 is fitted with the mount 35.

Thereafter, the head 37 is rotated substantially 90° clockwise (in the direction of arrow B) so as to be switched from the unlocking position to the locking position. As a result, the cam surface 38 of the head 37 serving as the engaging portion presses the periphery of the mounting hole 28*a* serving as the engaged portion or the upper and lower portions rightward or toward the mount 35, whereby the embroidery sewing presser foot 17 is fixed to the presser bar 10, as shown in FIGS. 7D and 8C. Furthermore, when the embroidery sewing presser foot 17 is to be detached, the head 37 is switched from the locking position to the unlocking position. Consequently, the mounting plate 28 can be dropped out of the mounting hole 21.

According to the above-described presser attaching mechanism 13, the mount 35 located at the lower end of the presser bar 10 is provided with the operating member 36 which is switchable between the locking position where the presser holder 14 or the embroidery sewing presser foot 17 is fixed and the unlocking position where the presser holder 14 or the embroidery sewing presser foot 17 is released from the fixed state. As a result, the presser holder 14 or the embroidery sewing presser foot 17 can easily be attached to and detached from the presser bar 10. Furthermore, the operating member 36 is rotatively movable and the presser holder 14 is formed with the mounting hole 21*c* or the embroidery sewing presser foot 17 is formed with the mounting hole 28*a*. Thus, the presser attaching mechanism 13 can be realized by a simple construction. Furthermore, since the operating member 36 is rotatively movable, the user can easily operate the operating member 36.

Particularly in the embodiment, the presser holder 14 or the embroidery sewing presser foot 17 is pressed against the presser bar 10 by the biasing force of the wave spring 39 serving as the biasing unit. As a result, the presser holder 14 or the embroidery sewing presser foot 17 can be fixed to the presser bar 10 in a closely adhering state when the operating member 36 occupies the locking position. In this case, since the presser holder 14 or the embroidery sewing presser foot 17 is pressed against the presser bar 10 by the two engaging portions or the two cam surfaces 38, the presser holder 14 or the embroidery sewing presser foot 17 can be fixed more stably. Furthermore, the operating member 36 can be prevented from being loosened by the biasing force of the wave spring 39 even during the sewing, whereupon the operating member 36 can reliably be retained at the locking position.

The biasing force of the wave spring 39 is varied by the provision of the inclined cam surfaces 38 in the operating member 36. When the user rotates the operating member 36 from the unlocking position to the locking position, an operating force to rotate the operating member 36 is gradually increased from a small force to a larger force. On the contrary, when the user rotates the operating member 36 from the locking position to the unlocking position, an operating force to rotate the operating member 36 is gradually decreased from a large force from to a smaller force. Accordingly, the user can sense the switching of the operating member 36 between the unlocking position and the locking position, based on the variation in the operating force. This can prevent erroneous operation due to carelessness.

Figure 11A:
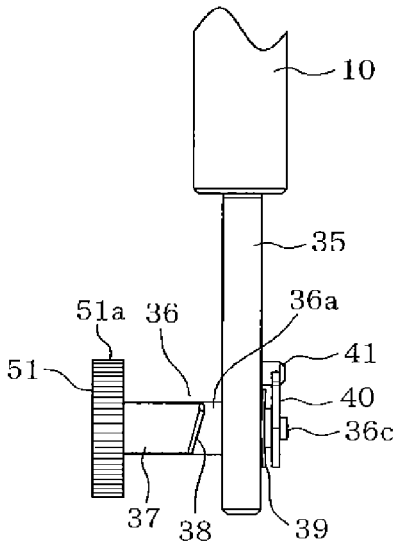
FIGS. 11A and 11B are a front view of the lower end of the presser bar and an exploded perspective view of the presser attaching mechanism according to another embodiment.
Figure 11B:
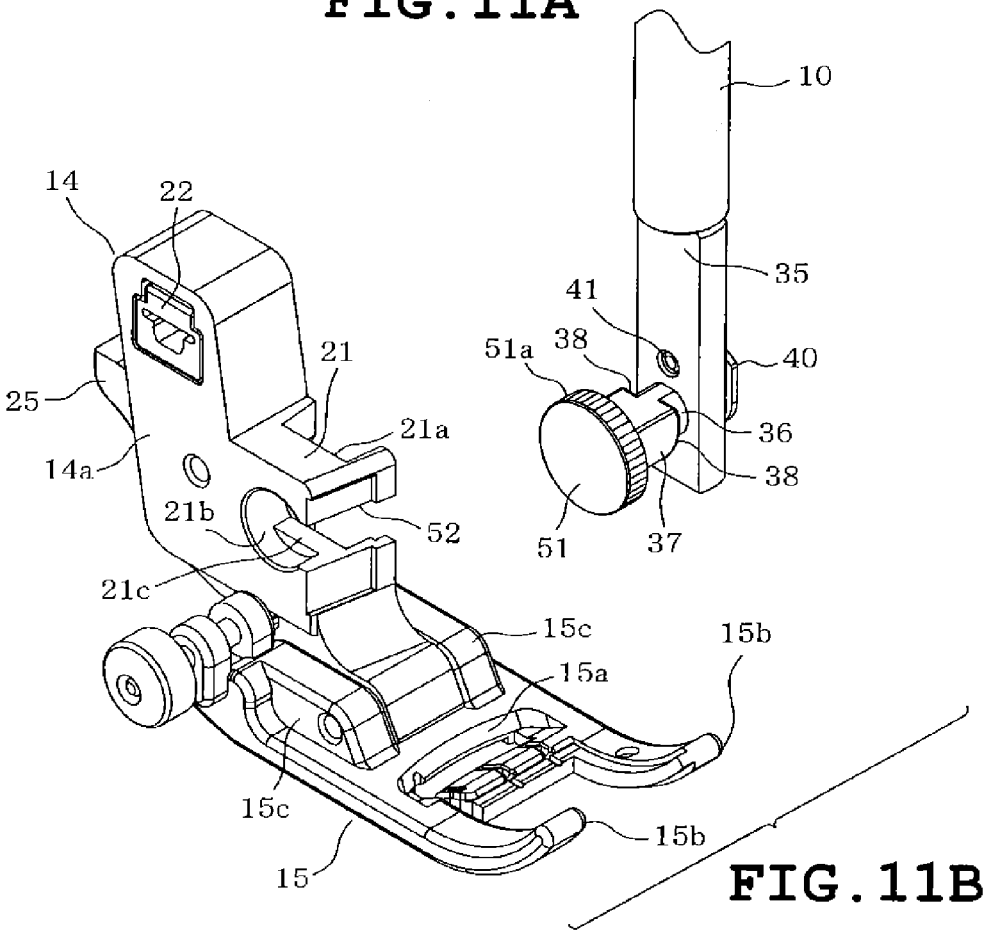

FIGS. 11A and 11B illustrate a second embodiment. The differences from the previous embodiment will be described. In the second embodiment, a disc-like knob 51 having a large outer diameter is provided on the distal end of the head 37 of the operating member 36, instead of the groove 37*a* for the tool. The knob 51 has a knurled head 51*a* formed on a periphery thereof. The knurled head 51*a* prevents user's fingers from slipping when the user rotates the operating member 36 with his/her fingers. The mounting wall 21 of the presser holder 14 is provided with a circular recess 21*b* and a mounting hole 21*c* both of which are formed so as to open via an opening 52 to the front of the presser holder 14.

The user switches the operating member 36 to the unlocking position in attachment of the presser holder 14 in the above-described configuration. The head 37 and the first shaft 36*a* are inserted through the opening 52 into the recess 21*b* and the mounting hole 21*c*. Subsequently, the user grasps the knob 51 to rotate the operating member 36 from the unlocking position to the locking position and fixes the presser holder 14. When the presser holder 14 is to be detached, the user grasps the knob 51 to rotate the operating member 36 from the locking position to the unlocking position and drops out the operating member 36 through the opening 52. Consequently, the presser holder 14 can easily be attached to and detached from the presser bar 10 without use of a tool such as a screwdriver.

The above-described embodiments should not be restrictive but may be modified or expanded as follows. For example, the presser holder 14 supporting the presser foot or the embroidery sewing presser foot 17 is detachably attached to the presser bar 10 in the foregoing embodiments. However, a device which is detachably attached to the presser bar may be various types of attachments. These attachments may include side cutters and walking feet. Additionally, various changes may be made in an overall construction of the sewing machine, the shape, structure and type of the presser foot.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A presser attaching mechanism for a sewing machine, which detachably attaches to a presser bar a presser foot pressing a workpiece cloth or a presser holder supporting the presser foot, the presser attaching mechanism comprising a locking mechanism which is provided on a lower end of the presser bar so as to be switchable between a locking position where the presser foot or the presser holder is fixed to the presser bar and an unlocking position where the presser foot or the presser holder is released from the fixed state to the presser bar, wherein:

the locking mechanism includes an operating member rotatable to the locking position and to the unlocking position;

the lower end of the presser bar is formed with a mount having a side from which the operating member protrudes;

the presser foot or the presser holder has a mounting wall and a mounting hole;

when the operating member is located at the unlocking position, the mounting wall is applied to the mount from a lateral direction, so that the operating member is inserted into the mounting hole; and the operating member is rotated from the unlocking position to the locking position, so that the operating member fixes the mounting wall to the mount, wherein the locking mechanism has a biasing member which presses the operating member in a direction such that the mounting wall is pressed against the mount, when the operating member is located at the locking position.

2. The presser attaching mechanism according claim 1, wherein:

the operating member has a cam surface inclined in a direction of extension of the presser bar; and the cam surface is configured to press the mounting wall.

3. A sewing machine comprising:

a sewing machine body;

a presser bar provided on the sewing machine body so that a presser foot pressing a workpiece cloth or a presser holder supporting the presser foot is detachably attached to the presser bar; and a presser attaching mechanism including a locking mechanism which is provided on a lower end of the presser bar so as to be switchable between a locking position where the presser foot or the presser holder is fixed to the presser bar and an unlocking position where the presser foot or the presser holder is released from the fixed state to the presser bar, wherein:

the locking mechanism includes an operating member rotatable to the locking position and to the unlocking position;

the lower end of the presser bar is formed with a mount having a side from which the operating member protrudes;

the presser foot or the presser holder has a mounting wall and a mounting hole;

when the operating member is located at the unlocking position, the mounting wall is applied to the mount from a lateral direction, so that the operating member is inserted into the mounting hole; and the operating member is rotated from the unlocking position to the locking position, so that the operating member fixes the mounting wall to the mount, wherein the locking mechanism has a biasing member which presses the operating member in a direction such that the mounting wall is pressed against the mount, when the operating member is located at the locking position.

4. The presser attaching mechanism according to claim 3, wherein:

the operating member has a cam surface inclined in the direction of extension of the presser bar; and the cam surface is configured to press the mounting wall.

* * * * *